US005473847A

United States Patent [19]

Crookston

[11] Patent Number: 5,473,847

[45] Date of Patent: Dec. 12, 1995

[54] VENTILATED INSULATED ROOFING SYSTEM

[75] Inventor: Anthony J. Crookston, Clinton, Ohio

[73] Assignee: Old Reliable Wholesale Inc., Barberton, Ohio

[21] Appl. No.: 264,315

[22] Filed: Jun. 23, 1994

[51] Int. Cl.[6] ..... E04B 7/00; E04C 2/10

[52] U.S. Cl. ..... 52/302.1; 52/95; 52/302.3; 52/408; 454/260

[58] Field of Search ..... 52/95, 302.1, 302.3, 52/302.4, 302.6, 302.7, 408, 410, 22, 309.4, 309.8, 309.9; 454/185, 260

[56] References Cited

U.S. PATENT DOCUMENTS

| | | | |
|---|---|---|---|
| 3,763,605 | 10/1973 | Freeman | 52/58 |
| 3,817,009 | 6/1974 | Elder | 52/173 |
| 4,651,494 | 3/1987 | Van Wagoner | 52/593 |
| 4,776,262 | 10/1988 | Curran | 52/95 X |
| 4,804,578 | 2/1989 | Crookston | 428/304.4 |
| 4,807,409 | 2/1989 | Sells | 454/260 X |
| 4,852,314 | 8/1989 | Moore, Jr. | 52/302.3 X |
| 4,937,990 | 7/1990 | Paquette | 52/302.3 X |
| 5,069,950 | 12/1991 | Crookston | 428/156 |
| 5,369,926 | 12/1994 | Borland | 52/302.1 |

*Primary Examiner*—Carl D. Friedman

*Assistant Examiner*—Kien T. Nguyen

*Attorney, Agent, or Firm*—Oldham, Oldham & Wilson Co.

[57] ABSTRACT

A ventilated insulated roofing system comprises a rigid roof deck, a roof comprising a rigid roof support member or sheathing which is above and spaced from the roof deck, and an exterior covering layer supported on the sheathing, and an insulation course between the roof deck and the sheathing. The insulation course is preferably a rigid lightweight foamed insulation material comprising an imperforate first portion which rests on the roof deck and a second portion comprising a plurality of spaced projections forming a network of interconnected air channels which are in communication with the under side of the sheathing. The roofing system further includes a course composed of one or more panels along a peripheral edge or portion of the perimeter of the roofing system. Each panel includes a rectangular board, a rigid foam insulation member which comprises a first imperforate portion and a second portion having projections extending from the first portion to the rigid board, forming a network of interconnecting air channels, a horizontally extending vent adhered to the rigid board for admitting air to the under side of the rigid board while excluding moisture, at least one protective air and water impermeable sheet for protecting the insulation member from moisture, and a vent associated with the protective sheet for admitting air to air spaces in the panel and the roofing system while excluding moisture.

14 Claims, 6 Drawing Sheets

VENTILATED INSULATED ROOFING SYSTEM

TECHNICAL FIELD

This invention relates to a ventilated insulated roofing system for a building structure and to a panel for use in connection therewith. More particularly, this invention relates to a panel which is adapted to be installed along an edge or perimeter of a roof which provides a vent for admitting air to an air space beneath a roof while keeping out moisture.

BACKGROUND OF THE INVENTION

Various roofing structures and systems are known. The object of most roofing systems is to provide insulation for the building which the roof covers, to keep the building dry and yet to prevent water vapor from accumulating within the roofing system or structure. Accumulation of water vapor is damaging or destructive to the roofing system. Yet it is difficult to keep water out of the building and at the same time to prevent build-up of water vapor within the roofing structure. In addition, the roofing system must be strong enough to support any wind load and snow loads to which it is subjected, to permit a person to walk on the roof, and (where desired) to support an aesthetically pleasing exterior covering which constitutes the top layer of the roofing structure. Existing roofing systems achieve the aforesaid objects with varying degrees of success. In some cases there is a tradeoff in which performance in one area is sacrificed in order to achieve top performance in another area. In particular, it is difficult to keep a building dry and at the same time to prevent the build-up of water vapor within the roofing structure. Various constructions have been proposed in order to achieve both objects.

Significant improvements in roof insulation have been accomplished with the insulated roof board structures shown in U.S. Pat. Nos. 4,804,578 and 5,069,950, both to Anthony J. Crookston, Sr. (the inventor herein). A foamed plastic insulation member as described in U.S. Pat. No. 5,069,950 is a particularly preferred insulation member for roofing systems. Structures of these patents provide excellent insulation systems for both insulating a building and for venting water vapor efficiently so that it does not condense within the roofing structure.

A pitched roof, i.e., a sloped roof with or without gutters at the caves, is subject to severe infiltration of water, condensed moisture, at the juncture of roof sheathing and fascia board. This is especially true on low-pitched roofs due to a siphoning action. Both low pitched and steep pitched roofs are subject to water infiltration and damage as are a result of overflow when an ice dam forms at the roof's eave edge. When this happens, the resulting damage to the soffit materials, rafter ends, and roof sheathing is extensive. In those instances where an overhang is not employed, severe damage is also inflicted to the interior of the structure requiring the removal of drywall or plaster, repairing any damage to windows or doors, and repainting.

Flat roofs are also subject to water infiltration and to damage, particularly along the perimeter of a roof at a juncture between the roof and a wall or parapet which extends above the outer surface of the roof.

While the state of the art is aware of a number of roofing systems, including systems which include insulation, very little tension has been paid to structures at the perimeter of a roof which address the problems noted above the entry of air into an air space beneath the roof for purposes of ventilation.

SUMMARY OF THE INVENTION

This invention according to one aspect provides a roofing system comprising a roof deck having an upper surface; a roof comprising a rigid supporting member above and spaced from the deck to provide an air space and having upper and lower surfaces and an exterior covering layer laid on the upper surface of the supporting member; and a course comprising a plurality of panels as will be described below along at least a portion of the perimeter roofing system for admitting air while keeping out moisture.

The roofing system preferably further comprises a rigid foamed plastic insulation member disposed on top of the upper surface of the deck and being of such structure as to provide interconnected air channels for venting of air and water vapor to the perimeter of the roofing system.

This invention according to a further aspect provides a novel panel for a roofing system as described above. This panel is rectangular in shape and comprises a rigid, coherent rectangular board which has opposite first and second surfaces and a longitudinally extending peripheral edge surface which intersects both, a rectangular rigid foam plastic insulation member adhered to the second surface of the board having formed therein interconnected in channels for venting of air and water vapor to peripheral edges of the insulation member; sheeting comprising one or more sheets of air and water impermeable material for protecting the insulation member and the peripheral edge surface of the rigid coherent board from moisture. A vent associated with the sheeting and extending longitudinally in proximity with a peripheral edge surface of the rigid board for admitting air and water vapor to an air space beneath the rigid board while excluding moisture.

Panels according to this invention may be used in conjunction with either a flat roof or a pitched roof, although the structural details of the panels for each type of roof will differ.

DETAILED DESCRIPTION

Figure 1:
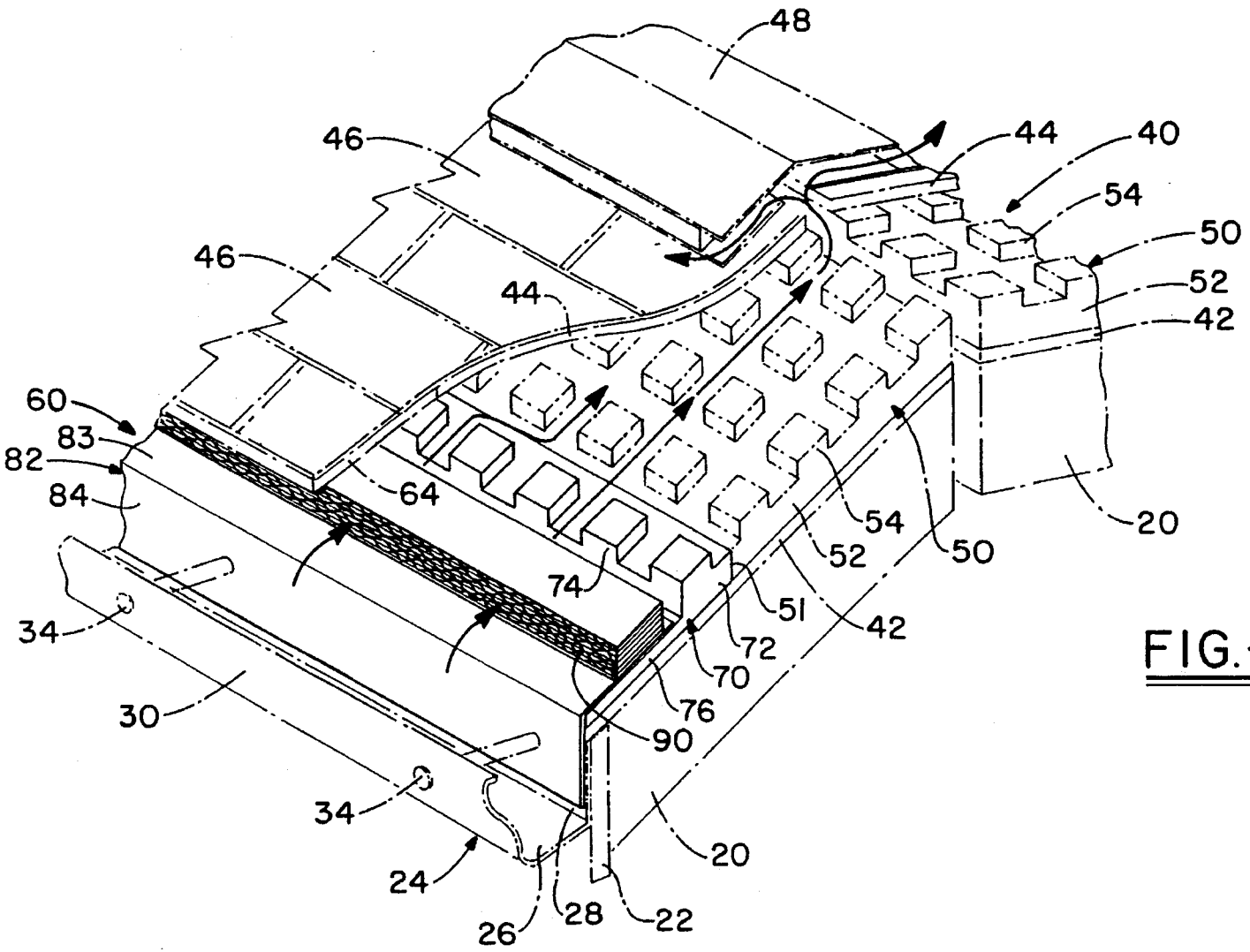
FIG. 1 shows a roofing system having a pitched roof (specifically a gable roof) and including at least one panel according to a first embodiment of this invention along a peripheral edge thereof.

Roofing systems and panels according to the present invention can be applied to either pitched roofs or flat roofs.

A course of panels according to this invention is installed along the perimeter of a roof or a portion of the perimeter.

FIGS. 1–4 illustrate a roofing system and a panel according to a first embodiment of this invention. The roofing system and the panel according to this first embodiment are for use on a pitched or sloping roof. The description will be with particular reference to a gable roof.

Referring now to FIGS. 1–4, a gable roof building structure to which the first embodiment of this invention is applied may comprise a plurality of sloping rafters 20, one of which is shown, and a vertical fascia board 22 nailed to the ends of the rafters. The outermost rafters at the sidewalls of the building, including the rafter 20 shown, are frequently referred to as rake boards. Both the rafters and the fascia board are ordinarily wooden boards in a building of either frame or masonry construction. Fascia board 22 runs along a lower edge of a gable roof. An essentially horizontal gutter 24 may be affixed to fascia board 22. Gutter 24 may be of conventional construction comprising a bottom wall 26, a first side wall 28 extending upwardly from one vertical edge of the bottom wall 26, and a second side wall 30 extending upwardly from a second lateral edge of the bottom wall 26. The first side wall 28 is vertical and may abut the fascia board 22 as shown. The gutter 24 includes a plurality of hangers 32 (shown in FIG. 3) at spaced intervals so that the gutter will keep its shape. The structure described so far (i.e., rafters, fascia board and gutter) is conventional.

The gutter 24 may be affixed or nailed temporarily to the fascia board 22 by means of roofing nails 34. A completed roofing structure will be described subsequently with reference to FIG. 3.

A roofing system 40 according to this invention comprises a roof deck or base member 42, which is mounted (e.g., by nailing) directly on top of rafters 20, and a roof which comprises a protective layer, i.e. roof support member or sheathing 44 which is spaced from and parallel to deck 42, and an exterior roof covering layer here shown as shingles 46, which are nailed or otherwise affixed to the roof support member or sheathing 44. Both the deck 42 and the sheathing 44 in this embodiment slope at an acute angle to the horizontal.

The deck 42 is a rigid structure capable of supporting the entire roof system and may be made of known deck materials such as solid wood, plywood, a coherent particle board, steel, or concrete. A wooden deck, especially plywood, is ordinarily preferred in houses and other low-rise buildings.

Deck 42 may be either horizontal or sloping. In the preferred embodiment shown in FIGS. 1–4, which illustrates a gable roof construction, deck 42 is sloping. Deck 42 extends from a roof ridge to a peripheral edge of a roof (which is lower than the roof ridge). The peripheral edge of the roof may overhang an adjacent vertical building wall or alternatively may be substantially flush with the exterior surface of the vertical building wall.

The roof support member or sheathing 44 may also be a wooden board, preferably plywood. Especially in low-rise buildings, the deck 42 and the sheathing 44 are preferably made of the same material, e.g., wood (especially plywood) and may have the same thickness. Both are hard, rigid, coherent members or layers which are capable of supporting a load. An exterior roof covering material such as shingles 46 may be supported on sheathing 44.

The structure comprising a deck 42 and sheathing 44 which are spaced apart differs from a conventional roof structure in that a conventional roof structure will typically have sheathing which is nailed directly onto rafters, and an exterior roof covering material such as shingles 46 nailed to the sheathing.

The roofing system 40 may further include one or more roof vents 48 for the purpose of venting air and water vapor from a space beneath a roof, i.e., on the underside of sheathing 44. One such vent 48, at the ridge or crown of a roof, is shown in FIG. 1. It is known in the art to provide either one or more than one roof vent.

An insulation course 50 may be interposed between the deck 42 and the sheathing 44. This insulation course or layer 50 rests directly on top of the upper surface of deck 42. The structure of the insulation course 50 is such as to provide a continuous network of passageways extending from one roof edge to another for venting air and water vapor from the space between the deck 42 and the sheathing 44.

The preferred insulation course 50, shown in the drawings, is in accordance with U.S. Pat. No. 5,069,950 cited supra. Other types of insulation which provide for air circulation beneath a roof (typically through a system of interconnected air channels) can be provided in the main portion of the roofing system. Insulation can be omitted in the main portion of the roofing system although this is not preferred.

While the roof deck 42 extends all the way to a roof edge, the sheathing 44 and insulation course 50 also extend from a roof ridge but terminate short of the roof edge, so as to leave space for a starter course according to this invention, which will be described subsequently. The insulation course 50 and the sheathing 44 terminate at a plane 51 which is perpendicular to the roof deck 42 and parallel to the roof edge (and to fascia board 22). The distance between plane 51 and the roof edge is equal to the desired width of the starter course.

A preferred form of insulation course 50 is as shown in U.S. Pat. No. 5,069,950. The insulation course 50 preferably comprises a plurality of individual insulated roof board members of rigid, coherent, lightweight insulating material such as polyisocyanurate (which is preferred) or polystyrene (e.g., expanded polystyrene or EPS). Either 1 pound or 2 pound grades of expanded polystyrene can be used. All of these materials are rigid, light in weight and yet strong, and have high R values, which denote that they are good thermal insulators. These materials are cellular in nature, either open or closed cell, typically comprising a large number of tiny air cells which do not communicate with the outside as is well-known. Alternatively but less desirably, other lightweight insulating materials may be used in place of a rigid foamed plastic material. Insulated roof board members forming insulation course 50 are preferably similar to their counterparts (insulated roof board members 12) in U.S. Pat. No. 5,069,950. They may be in the form of panels of desired size, e.g., 4'×8' or 4'×4'. The overall thickness of both the insulation course 50 and an individual panel member may be from about 1.5 to about 4 inches.

An insulation roof board member (or insulation member) is preferably formed from a rectangular block of the desired insulating material, e.g., by cutting away portions thereof to form a desired channel pattern, as more fully disclosed in U.S. Pat No. 5,069,950. The insulation members forming course 50 each comprise an imperforate first or base portion 52 which extends from a planar first or base surface (which is in abutting relationship with a top surface of roof deck 42) to a planar second or intermediate surface, and a second or top portion 54 composed of a plurality of spaced, square projections (or blocks) which extend upwardly from the base portion and form a plurality of interconnected air channels therebetween. The tops of projections 54 lie in a common plane (a third or top plane) which is parallel to the first or base plane. The base portion 52 is preferably in rectangular block form, with no air channels cut either through it or along any of its surfaces or edges. The spaced projections 54 which form the top portion are integral with the base portion 52, i.e., they are either integrally formed with or integrally joined to the base portion 52. Projections 54 may be arranged in a square pattern as shown in the drawings. An interconnected network of air channels formed by projections 54 include a first series of channels which are parallel to a roof edge (and to fascia board 22) and a second series which are perpendicular to that roof edge (and fascia board 22), permitting efficient venting of air or water vapor in both directions over the entire extent of the roof structure. These channels are disposed at the same level or elevation, i.e., both lie between the top plane and the intermediate plane of the insulation. Preferably the widths of the projections 54 and the widths of the channels therebetween are the same and the projections 54 may be 1.5 inches square and the channels therebetween 1.5 inches wide, by way of example, so that the area in the upper portion of the insulation course 50 which is devoted to channels is ¾ of the total area. The projections 54 support the sheathing 44; the top plane of projections 54 and plane of the bottom surface of sheathing 44 is the same.

A water and water vapor impermeable membrane (not shown) may be present if desired. Such membrane, when present, is typically placed between deck 42 and insulation 50.

A roofing system 40 according to this invention further comprises a starter course composed of a plurality of rectangular panels 60, which are disposed along an edge of the roof. For purposes of illustration these panels 60 are shown as being disposed along a lower edge of a roof structure adjacent a fascia board 22. These rectangular panels may be of any convenient size, for example, 8 feet long (running in a direction parallel to the roof edge and fascia board 22) and from about 16–24 inches wide (measured in a direction perpendicular to the same roof edge and fascia board 22). The length L and the width W (shown in FIG. 4) of a panel may both be either greater or less than these representative dimensions; for example, the width may vary from about 1 foot to about 4 feet, and the length may vary from about 4 feet to about 10 feet. These dimensions are selected for convenience and are not critical.

A panel 60 comprises a rigid, coherent, rectangular board 64, which is aligned with and in effect is a continuation of sheathing 44. This board 64 is for the purpose of supporting the outermost portion of the roof covering layer, e.g., the lowermost courses of shingles 46. This board member 64 is preferably of the same thickness as sheathing 44 and is preferably made of wood, e.g., plywood or (less desirably) a coherent particle board. This board 64 has opposite planar surfaces, i.e., a first or top surface **64*a* and a second or bottom surface 64*b*. The board 64 also has a pair of opposite edge surfaces and a pair of opposite end surfaces, all of which intersect and are perpendicular to the top and bottom surfaces. One of the edge surfaces, i.e., the inner or upper edge surface, is in abutting relationship with the lowermost edge of sheathing 44 at plane 51. The other edge surface 64*c* is a lower or outer peripheral surface and is at an outer edge of the roofing system. The outer edge of board 64 is approximately aligned with the outer or lower edge of deck 42**, although these two end surfaces do not have to be exactly aligned.

A panel 60 further comprises a rigid rectangular insulation member 70, which in turn comprises an imperforate base or lower (or first) portion 72, a top (or second) portion composed of a plurality of spaced projections 74 integral with and extending upwardly from the base portion 72 with a network of interconnected air channels between the projections, and a peripheral edge (or third) portion 76 which is preferably thinner than the first portion 72. All three portions 72, 74, and 76 are preferably integral. The structure of the first and second portions 72 and 74, respectively, is similar to the structures of the base portion 52 the spaced projections 54, respectively, of insulation course 50.

The inner edge surface and the two end surfaces of insulation member 70 are coplanar with their counterparts in the roof support board 64. When installed in a roofing system, the inner edge surfaces of both the roof support board 64 and the insulation member 70 will be in abutting relationship with the outer or lower edge surfaces of sheathing 44 and insulation course 50, respectively, at plane 51. The materials which may form the insulation member 70 are the same as those which form the insulation course 50, e.g., polyisocyanurate or polystyrene. Preferably the same material is used for both the insulation course 50 in the main portion of the roofing system and for the insulation members 70 in the panels 60. The projections 74 are preferably of the same size and shape as the projections 54 in the insulation course 50, and the channels which run perpendicular to the fascia board 22 are preferably aligned. The tops of projections 74 are adhered to the under side of support board 64.

The first and third portions 72 and 76, respectively, of insulation member are both rectangular in shape and are in side by side relationship. In effect, the third portion 76 extends laterally from the first or main portion 72. Both are imperforate. The outer boundary of the first portion is a plane which is inward of the outer edge surface of roof support board 64. The outer edge surface of the third portion 76, which is also the outer edge surface of the insulation member 70 as a whole, may be aligned either approximately or exactly with the outer edge surface of roof support board 64. As installed, it is preferable for the outer edge surface of insulation member 70 to be aligned with the outer edge surface of roof deck 42. There are no projections extending upwardly from the third portion 76, leaving an air space between this third portion 76 and the roof support board 64.

Panel 60 further comprises protective sheet means 80 for protecting the insulation member 70 and the peripheral edge **64*c* of rigid board 64 from moisture. The protective sheet means in this embodiment comprises two sheets 81 and 82 of sheet material. This sheet material is impermeable to both liquid moisture (water) and to air and water vapor, and is preferably a thin gauge metal, with particularly either copper or aluminum. Standard flashing, which is usually metallic and preferably either copper or aluminum and is typically thin, say about 0.019 inch (which is a standard thickness), is the preferred material for both the first metal sheet 81 and the second metal sheet or apron 82**.

The first sheet 81 is of generally U-shaped configuration. This sheet overlies and covers the peripheral edge **64*c* and adjacent portions of the first surface 64*a* and second surface 64*b* of rigid board 64, protecting the same from moisture. The sheet 81 may be adhered to the board 64** by suitable means, e.g., a waterproof adhesive.

Figure 3:
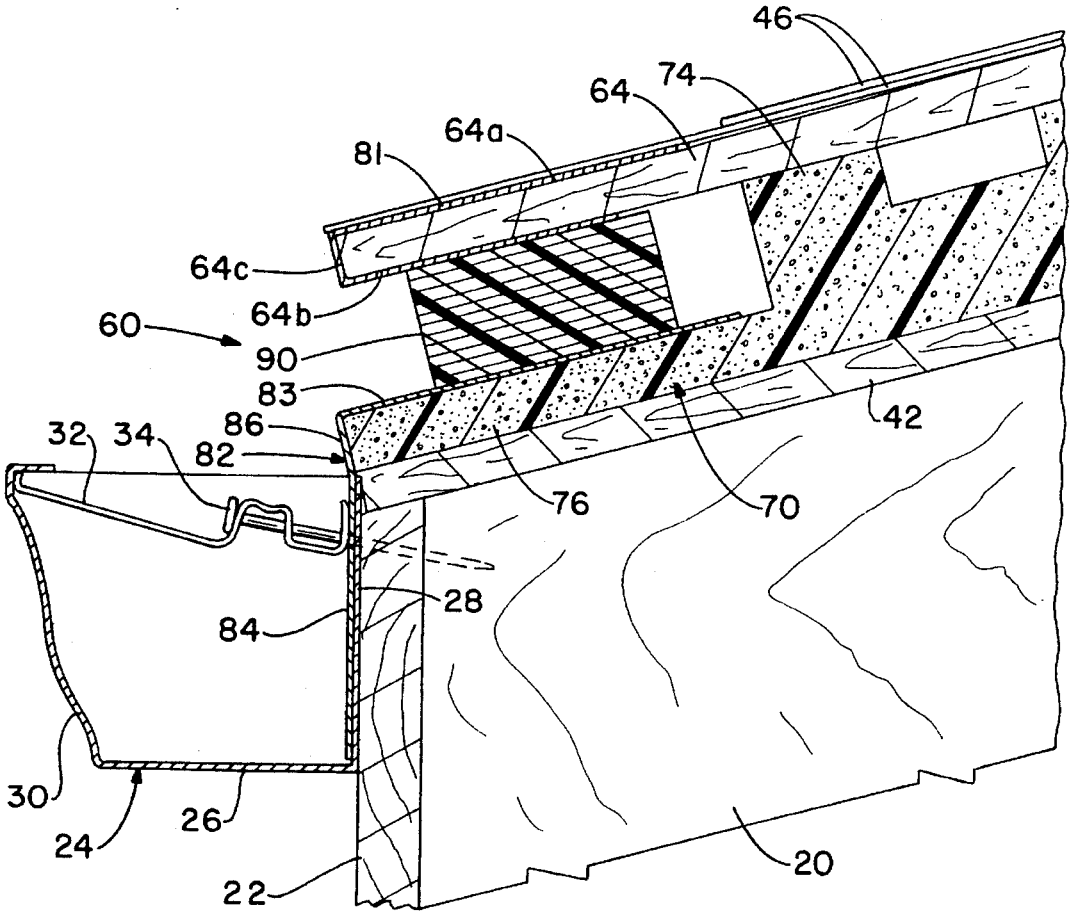
FIG. 3 is a vertical sectional view on an enlarged scale of a portion of the roofing structure shown in FIG. 2.
Figure 4:
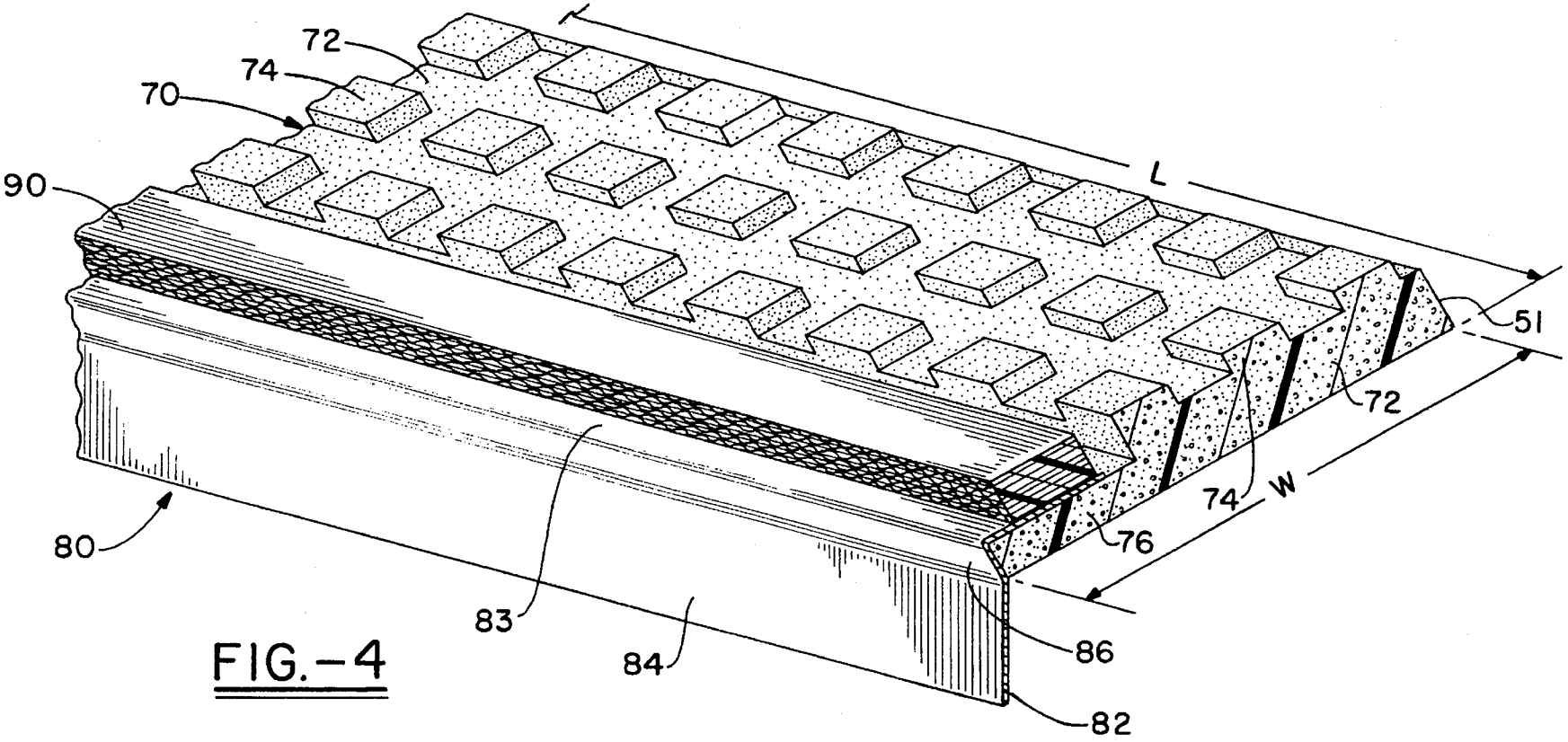
FIG. 4 is a perspective view of a panel according to this invention, with parts broken away and with the top or support member for an exterior roof covering removed.

The second sheet or apron 82 has a first portion 83 which is adhered directly to the upper surface of the edge portion 76 of the insulation, and a second portion 84 which is disposed at either a right angle or an obtuse angle to the first portion 83. The angle between the first portion 83 and the second portion 84 is such that the second portion 84 will hang vertically downwardly, e.g., into the gutter 24 as shown in FIG. 3, when installed on a roof. The first portion 83 of apron 82 is parallel to the surfaces of roof deck 42. Therefore the angle between portions 83 and 84 will be an obtuse angle in a panel 60 which is intended for use on a sloping roof having a sloping deck. The preferred apron 82 further includes a third portion 86, which is disposed between the first and second portions and at right angles to the first portion. This third portion 86 overlies the outer edges of roof deck 42 and insulation member 70 when installed.

Panel 60 further includes a horizontally extending vent or ventilator 90, which extends longitudinally and is parallel to and in proximity with the outer edge 64*c* of the roof support board 64. The vent 90 is disposed between sheets 81 and 82 and is adhered to each. This vent 90 comprises flat (or planar) sheets and corrugated sheets in alternating sequence. The flat sheets are parallel to each other and to board 64. Preferably both outside sheets are flat sheets. A first or uppermost outside sheet has a first outer surface which is attached to a surface of metal sheet 81. This first outer surface of vent 90 sealingly engages the first metal sheet 81, which in turn engages board 64. A second or lowermost outside sheet of vent 90 has a second outer surface (which is parallel to the above described first outer surface) which sealingly engages the second sheet or apron 82. Such engagement may be either frictional engagement or may be provided by either an adhesive or solder. Vent 90 is open along both lateral edges (at the lateral edges of the flat and corrugated sheets). The alternating flat and corrugated sheets provide a plurality of passageways through the vent from the exterior to the air space between the board member 64 and the insulation member 70. There is an unobstructed air space between the board 64 and the insulation member 70, since the outer boundary of the first or main portion 72 of the insulation member 70 is disposed inwardly of the inner lateral edges of the flat and corrugated sheets forming vent 90. Air and water vapor contained therein can flow freely through these passageways, but the small size of these passageways compared to their length (since successive flat sheets are disposed close together) effectively excludes liquid water (or moisture). This keeps the insulation member 70 dry, even in a driving rainstorm. The two protective sheets 81 and 82 and the vent 90 together form an assembly which protects the panel 60 from moisture. In particular the peripheral portions of rigid board 64 and insulation member 70, including the peripheral edge 64*c* of board 64, are so protected.

A plurality of panels 60 are installed in abutting end to end relationship on top of a roof deck 42 along a peripheral edge of a roof. This peripheral edge is a lower edge in the case of a sloping roof. The panels 60 are preferably installed on top of deck 42 so that the peripheral edge surfaces of the insulation member 70 of a panel 60 are aligned with the peripheral edge surfaces of the deck 42. When an entire roofing system including panels 60 at the perimeter of a sloping roof and insulation 50 in the main portion of the roof are being installed at the same time, it is convenient to install the panels 60 first and to then install an insulation course 50 upwardly from the row of panels 60 to a ridge or peak of the roof. Then the insulation course 50 is installed from the starter course to the ridge of a roof. Then sheathing 44 may be installed from the panels up to the ridge of the roof. Finally, an exterior covering such as shingles 46 may be installed over the entire roof support structure including board 64 and sheathing 44.

A roofing system according to this invention comprises a main portion, which in turn comprises a deck 42, a roof support member (e.g., a sheathing board) 44 and an exterior covering layer 46, and an insulation course 50, and a plurality of panels 60 laid in abutting end to end relationship along one edge (e.g., a lower edge) of a roof structure. The respective vents 90 in each panel together form a continuous vent extending along an entire edge of a roof, and the respective insulation members 70 together form a continuous insulation course which is in fact a continuation of the insulation course 60 in the main portion of the roof.

Figure 2:
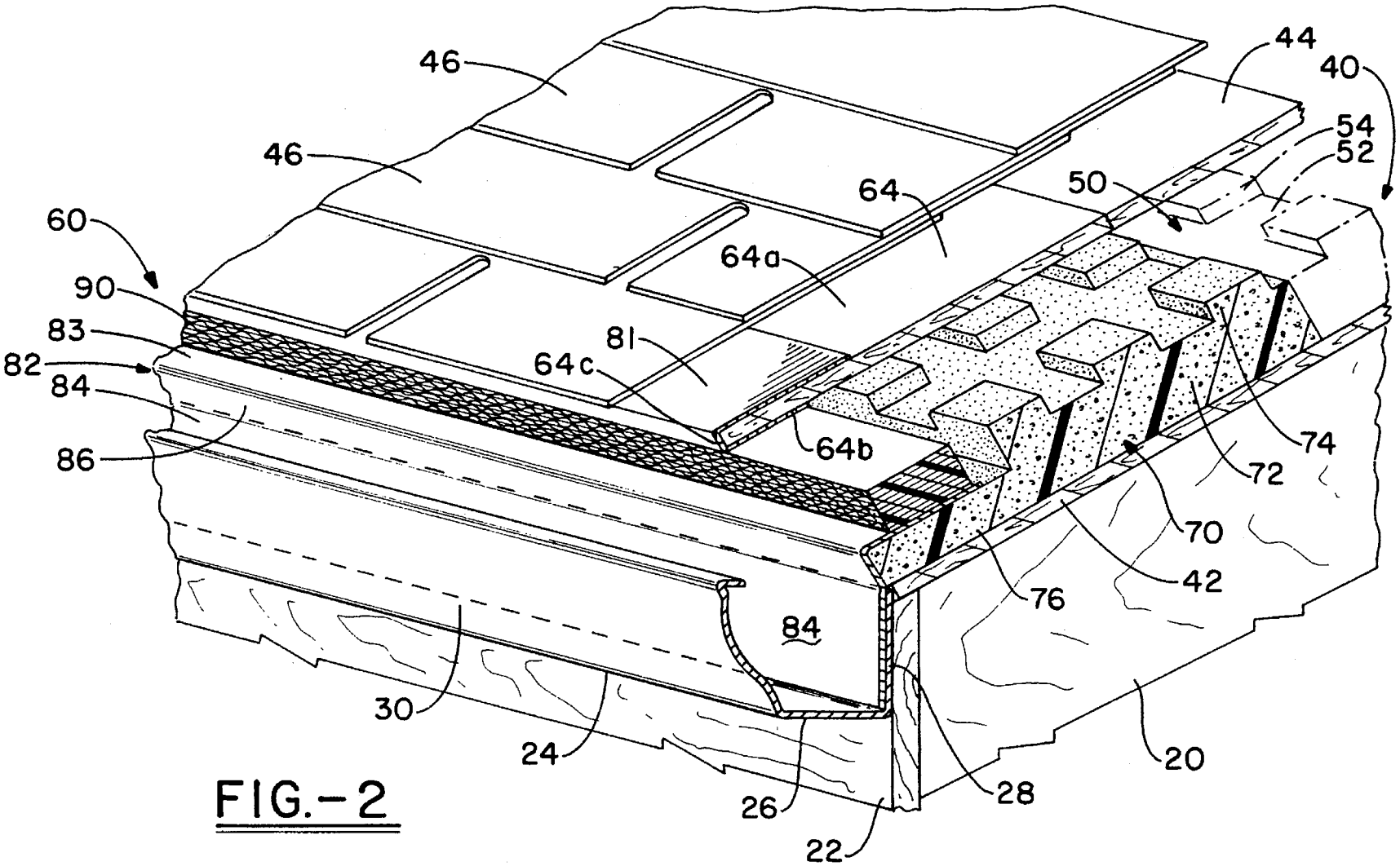
FIG. 2 is a perspective view, on an enlarged scale, with certain parts shown in section, of a portion of the roof structure shown in FIG. 1.

The panels 60 are preferably installed so that the second (or downwardly extending) portion 84 of apron 82 is inside the gutter 26 as shown in FIG. 2 so that one side wall 28 of the gutter 26 is directly against the fascia board 22 or other vertical exterior surface of the building structure. Both the gutter 24 and the downwardly extending portion 84 of protection sheet or apron 82 may be secured to a fascia board 22 by means of roofing nails 34, as shown in FIG. 3. This arrangement dramatically reduces the possibility of severe water damage at the juncture of roof sheathing and fascia board as above described.

In an alternative arrangement, the lowermost portion 84 of apron 82 may be placed next to fascia board 22, with the entire gutter 24, including the first or inner such wall 28 thereof, disposed outwardly of portion 84 of apron 82. This arrangement protects the fascia board 22 from moisture but does not protect as well as the arrangement shown in the drawings.

The roofing system of this invention provides efficient air circulation as shown in FIG. 1. Air enters the space beneath the roof through vents 90 along a roof edge. These vents prevent the entry of liquid water (moisture). Air circulates through the air channels between projections 54 and 74, and escapes through roof vent 48.

A roofing system and panels according to the present invention can be used on either new or existing building structures. A new building having a gable roof can be built with a roofing system and starter strip as shown and described herein. The roofing system and starter panel shown and described herein can also be used at a lower roof edge of other sloping roof structures, e.g., a hip roof or a shed roof.

One may also install a roofing system and starter panels of the present invention on an existing structure. In this case, the roof support member or board (i.e., the sheathing) of the existing roof prior to renovation becomes the roof deck 42. Panels 60 according to the present invention are installed along a peripheral edge of a roof where the roof intersects vertical building walls. Then an insulation course 50 is installed directly on top of the roof deck 42 over the remainder of the roof. For convenience, the insulation course may be made in the form of blocks or panels of any convenient size as explained earlier. A lower edge of the insulation course on each roof slope is in abutting relationship with the insulation member 70 of the panels 60, with air channels aligned. Then a new sheathing (or roof support member or board) 44 is laid. Finally, an exterior covering layer 46, e.g., shingles, is laid on top of the roof support member 44.

The panels 60 of this invention offer a major advantage in retrofit installations, in that they provide for venting of the air space beneath a roof (i.e., above the insulation course and below the sheathing and exterior covering) without having to tear out existing building structures, such as a fascia board and a soffit board, at a roof edge. It is typically necessary to remove the fascia board and the soffit board in a conventional roofing installation in order to vent the underside of the sheathing. The starter strips of this invention are particularly advantageous in a roofing system that includes insulation, since these starter strips are easy to install and they protect both the insulation and the air space beneath the roof from moisture while freely admitting air.

Figure 5:
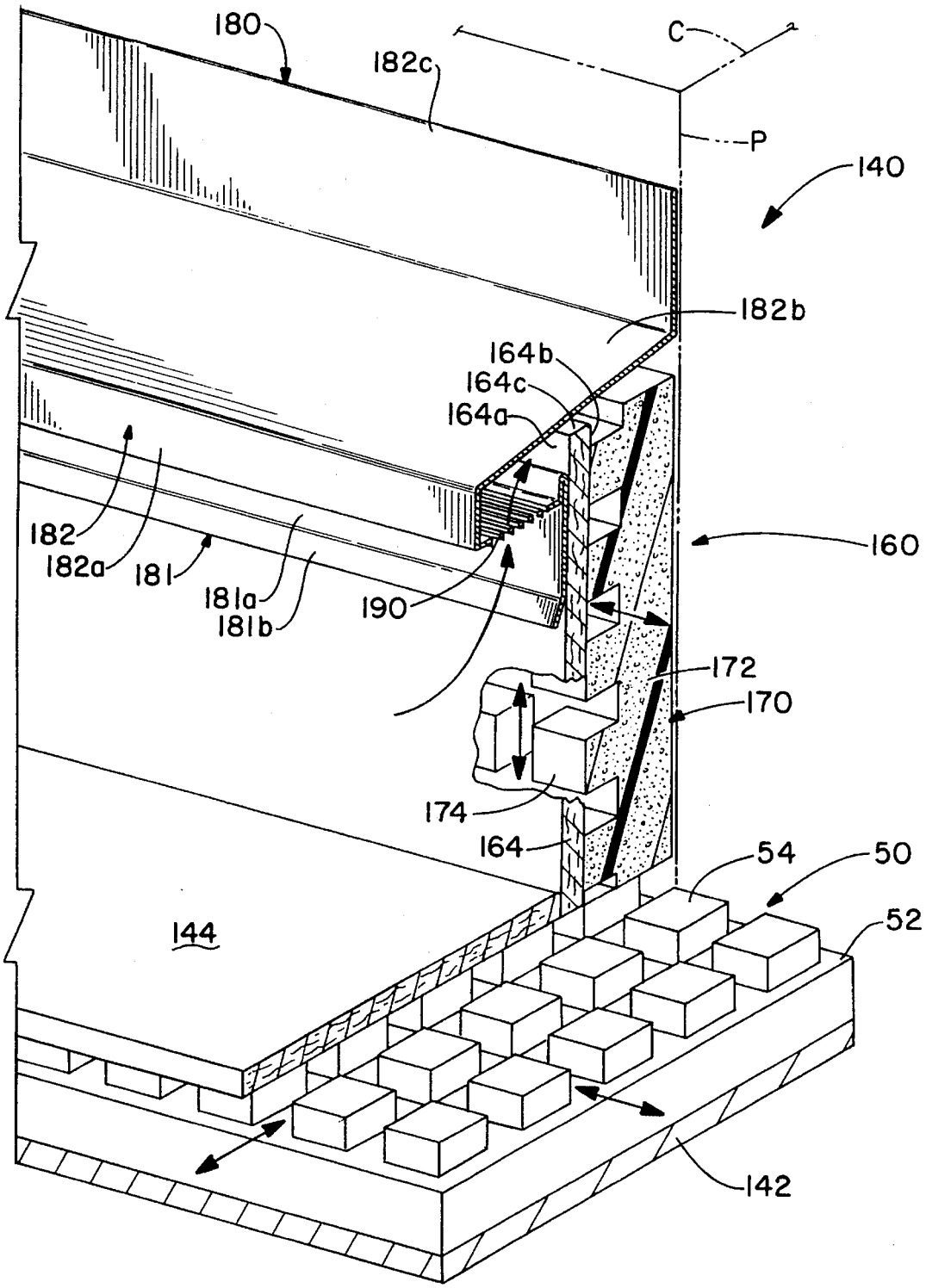
FIG. 5 is a perspective view, with parts broken away and parts shown in section, of a roofing system having a flat roof and including a panel according to a second embodiment of this invention along a portion of the perimeter thereof.

FIG. 5 illustrates a roofing system for flat roofs in accordance with this invention. A roofing system 140 in accordance with the embodiment shown in FIG. 5 includes a generally horizontally extending deck 142. The deck may be of conventional construction and may be constructed of a conventional rigid roof deck material such as steel, concrete or wood. The deck 142 typically extends over the entire expanse of a building and has a perimeter or periphery at the intersections between the deck and the building walls. A parapet P, which is an extension of one such wall is shown in phantom lines in FIG. 5.

The roofing system of FIG. 5 further comprises an upper or outer protective layer which is above and spaced from deck 142. This protective layer may comprise a rigid roof support board or sheathing 144 which is generally horizontal. This board or sheathing 144 may be made of suitable hard, dense rigid material, such as plywood or fiberboard, which is capable of supporting roof covering material as well as the weight of a person or persons walking on the roof. An exterior roof covering (not shown) appropriate to flat roofs, e.g., a combination of roofing paper, asphalt and bitumen, may be installed on top of the sheathing. The construction and materials described in this paragraph may be conventional and provide a waterproof roof covering.

An insulation course 50 may be interposed between the deck 142 and the sheathing 144. This insulation course 50, where used, may be of the same structure as that shown in FIGS. 1–4 and in U.S. Pat. No. 5,069,950, and comprises an imperforate first or base portion 52 (which may be in abutting relationship with deck 142) and a plurality of spaced projections 54 (here shown as square) extending upwardly from the base portion 52 and forming a plurality of interconnected air channels therebetween. The tops of projections 54 are at the underside of sheathing 144. Other types of insulation can be used, and, if desired, insulation can be omitted, provided that in any case that the structure is such as to provide an air space between the deck 142 and protective layer 144, and, in particular, on the underside of the protective layer 144.

A roofing system as shown in FIG. 5 may include a water and water vapor impermeable membrane (not shown) if desired (this is optional). This membrane, when present, may be placed between the roof deck 142 and insulation 50.

The roofing system 140 of FIG. 5 further includes a plurality of rectangular panels 160 installed end to end along a portion of the perimeter of the roof, e.g., along one peripheral edge where the roof meets a vertical building wall W. In this embodiment, the panels 160 are oriented upright. Panels 160 may be of any convenient size, say 8 feet long by 16 to 24 inches high.

A roof perimeter panel 160 includes an upright rectangular hard board 164 which extends longitudinally (i.e., horizontally) along the perimeter or portion of the perimeter of a flat roof. Hard board may be made of plywood (preferred) or coherent particle board. Hard board 164 is disposed at right angles to the roof board or sheathing 144, and is spaced from a parapet P, which is an extension of a vertical building wall (not shown). Parapet P is disposed above the flat roof of the building, i.e., above roof board 144 and any roof covering material thereon. Hard board has opposite first (or outer) and second (or inner) vertical surfaces **164*a* and 164*b*, respectively, which are parallel to each other, and a horizontal top or peripheral edge surface 164*c*, which intersects the two vertical surfaces 164*a* and 164*b*** and extends therebetween.

Panel 160 further includes an insulation member 170. Insulation member 170 provides a network of interconnected air channels adjacent to the second surface **164*b* of roof board 164. The preferred form of insulation member 170 is similar to insulation member 70 in FIGS. 1–4 and to the insulation member shown in U.S. Pat No. 5,069,950. This insulation member is made of a rigid foam material and comprises an imperforate first or base portion 172 which is disposed next to a vertical surface of parapet P, and a plurality of spaced projections 174, preferably square, which extend from the base portion 172 to the second surface 164*b* of roof board 164 and an adhered to the second surface. A system of interconnected air channels is formed between projections 174. The air channels in the panel 160 communicate with the air channels in the roofing system 140**.

A protective sheet 180 is provided to protect the panel 160, particularly the insulation member 170 and an upper peripheral portion of roof board 164, including the top peripheral edge **164*c*, from moisture while admitting air to the air space of panel 160 and of the flat roof system itself. Protective sheet 180 extends longitudinally the entire length of panel 160 and comprises a first longitudinally extending portion 181, a second longitudinally extending portion 182, and a longitudinally extending essentially horizontal vent 190** therebetween.

First longitudinally extending portion 181 comprises two longitudinally extending sections **181*a* and 181*b* in side-by-side relationship and separated by a longitudinally extending fold line. Section 181*a* overlies and may be adhered to the first or exterior surface 164*a* of rigid roof board 164. The second longitudinally extending section 181*b* is directed away from the exterior surface 164*a* of roof board 164 at an acute angle so as to deflect rain water or other moisture away from the outer surface 164*a* of roof board 164. In this way the portion 181 of protective sheet protects the outer surface 164*a* of board 164** from moisture.

The second portion 182 of protective sheet comprises three longitudinally extending sections **182*a*, 182*b* and 182*c*, which are in side-by-side relationship and separated by fold lines between adjacent sections (182*a*, 182*b* and 182*c*). The first section 182*a* may be vertical and is adjacent to (and at a right angle to) vent 190. The second section 182*b* may be horizontal or nearly horizontal and is spaced from the upper surfaces of rigid board 164 and insulation 170 so as to permit air circulation both within the panel 160 and between the panel 160 and the exterior. The third section 182*c* is upstanding or vertical and lies against a vertical surface of a wall or parapet P, to which it may be adhered. A metal cover sheet or cap C (which is conventional) may overlie the top surface of wall or parapet P and include a portion which extends downwardly along a vertical surface of parapet P and overlies the top edge of the third sheet section 182*c***. This protects the top surface and the inside vertical surface of the parapet P from weather (including rain, snow and wind).

Vent 190 is essentially horizontal and may extend longitudinally the entire length (or substantially the entire length) of panel 160. (The vent can stop short of the ends of the panel). The vent may be of conventional structure; for example, it may comprise a plurality of longitudinally extending louvers. Vent 190 faces downwardly so that its lower side is on the exterior of the panel 160. Vent 190 permits air to pass through in both directions while excluding moisture. The direction of air flow of course depends on the relative air pressures on the two opposite sides of the vent. Whichever way air flows, the vent provides for circulation of air between the air space in roofing system 140 and the outside.

The roofing system of FIG. 5 provides for efficient air circulation between air spaces in the roofing system and the outside while excluding liquid water (moisture). Assuming that the air pressure is slightly higher on the outside than in the air space of the roofing system, air will enter the roofing system air space from the outside via vent 190. Air will then travel through the space between the peripheral edge 164*c* of rigid board 164 and the protective sheet 180 thereabove, and will then flow successively through the air channels in insulation member 170 of panel 160 and the air channels in insulation course 50 in the main portion of the roof structure. The latter air channels provide air circulation on the underside of roof support member 144. Finally, air may be vented from the roofing system via one or more roof vents not shown. When the air pressure in the roofing system is greater than on the outside, the direction of air flow will be just the reverse. Efficient air circulation while excluding moisture is obtained in either case.

Figure 6:
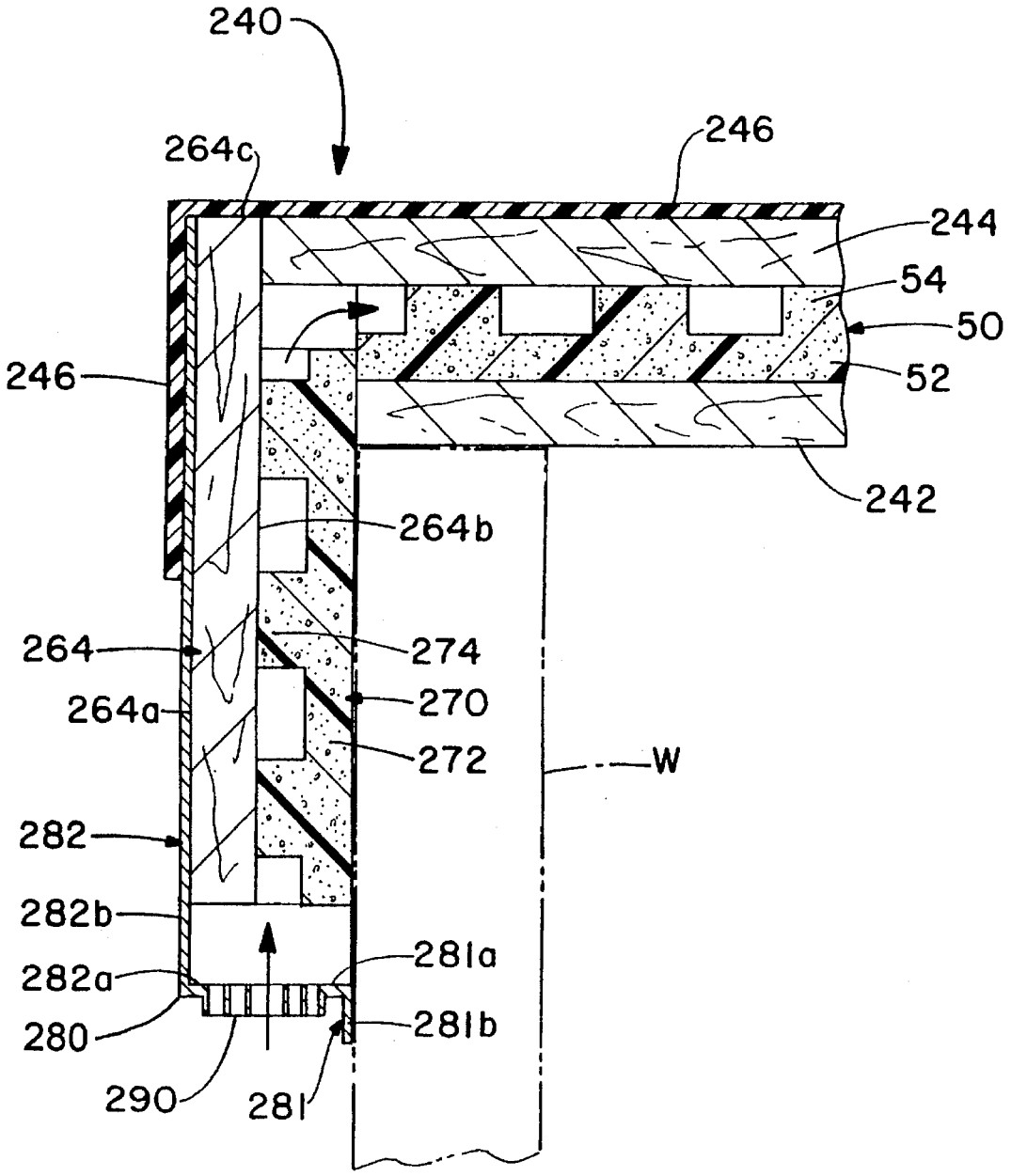
FIG. 6 is a vertical sectional view, with parts broken away, of a roofing system having a flat roof and including a panel according to a third embodiment of this invention along a portion of the perimeter thereof.

A third embodiment of the invention is illustrated in FIG. 6. This embodiment includes a roofing system for a flat roof which has no parapet, and a course of roofing panels installed along at least a portion of the perimeter of such roofing system.

A roofing system 240 in accordance with the embodiment shown in FIG. 6 is intended for a building having a plurality of vertical walls W, one of which is shown in FIG. 6, but no parapets. The roofing system 240 includes a generally horizontally extending deck 242, which is installed on top of a vertical building wall W, and an upper or outer protective layer which is above and spaced from deck 242. Deck 242 may be of conventional construction and may be formed of a conventional rigid, load bearing roof deck material such as steel, concrete or wood. Similarly, the protective layer may comprise a rigid roof support board or sheathing 244 which is generally horizontal and which may be formed of a suitable hard, dense rigid material such as plywood or fiberboard, an exterior roof covering 246, which may be either a rubber, plastic, bituminous or metal sheet or membrane or a combination of roofing paper asphalt or bitumen, is placed on top of support board or sheathing 244 in order to provide a waterproof outer layer. This roof covering 246 may extend downwardly at the perimeter of the roofing system 240.

Roofing system 240 further comprises a horizontally extending insulation course 50, which is interposed between the roof deck 242 and the support board or sheathing 244. The structure of the insulation course 50 in this embodiment may be the same as the structure of insulation course 50 shown in FIGS. 1–4. This insulation course may be in the form of panels of desired size laid edge to edge. Insulation course 50 comprises an imperforate first or base portion 52 which is in abutting relationship with a top surface of roof deck 242, and a second or top portion comprising a plurality of spaced projections 54 which extend upwardly from the first or base portion 52 to the underside of board or sheathing 244. These spaced projections provide an interconnected network of air channels under the board or sheathing 244.

Roofing system 240 further comprises a plurality of rectangular panels 260 which are laid end to end along at least a portion of a horizontally extending perimeter of a building, e.g., along one vertical exterior building wall W. Panels 260 are oriented upright. They may be of any convenient size, say 8 feet long by 16 to 24 inches high.

A roof perimeter panel 260 includes an upright rectangular hard board 264 having a horizontally extending longitudinal axis. Suitable materials include plywood (preferred) and coherent particle board (the same materials as those used in board 64 in FIGS. 1–4). Hard board 264 is spaced outwardly from and parallel to a building wall W. Board 264 has first (or outer) and second (or inner) vertical surfaces 264*a* and 264*b*, respectively; a longitudinally extending horizontal upper surface 264*c* which is preferably flush with an upper surface of roof board 244; and a longitudinally extending horizontal lower surface 264d. A membrane 246 overlies and covers the upper surfaces of roof board 244 and hard board 264, protecting the same from weather (including moisture). Membrane 246 has a depending skirted portion which overlies a portion of an outer vertical surface 264*a* of hard board 264 of panel 260.

Panel 260 further includes an insulation member 270, which is preferably made of a rigid foam material such as polyisocyanurate or polystyrene foam. (The same materials are preferred for all insulation members 50, 70, 170 and 270 herein). Insulation member 270 comprises a vertically extending imperforate first or base portion 272, which has a surface that abuts an outer vertical surface of an exterior building wall W, and a plurality or spaced projections, preferably square, which extend from the base portion 272 to an inner vertical surface of hard board 264. A system of interconnected air channels is formed between projections 274. The air channels in the panel 260 communicate with the air channels in the roofing system 240. The structure of insulation member 270 is basically similar to that of insulation member 170 shown in FIG. 5, and to the structures of insulation member 50 herein and to the insulation member shown and described in applicant's U.S. Pat. No. 5,069,950.

A protective sheet 280 is provided to protect the panel, particularly the hard board 264 and insulation member 270, from moisture while admitting air to the air spaces of panel 260 and of the flat roof system 240. Protective sheet 280 extends longitudinally the entire length of panel 260 and comprises a first longitudinally extending portion 281, a second longitudinally extending portion 282, and a longitudinally extending essentially horizontal vent 290 therebetween.

First longitudinally extending portion comprises two longitudinally extending sections 281*a* and 281*b*, which are at right angles to each other with a fold line therebetween. Section 281*a* is horizontal. Section 281*b* is vertical and overlies a portion of an outer surface of a vertical building wall W.

The second portion 282 of protective sheet 280 comprises two longitudinally extending sections 282*a* and 282*b*, which are at right angles to each other. First section 282*a* is horizontal and is preferably coplanar with surface 281*a*. Second section 282*b* is vertical, and overlies and protects the outer surface 264*a* of hard board 264. The depending portion of membrane 246, which was described earlier, overlies an upper portion of protective sheet section 282*b*, protecting the hard board 264 from weather and moisture.

Vent 290 is essentially horizontal and may extend longitudinally the entire length (or substantially the entire length) of panel 260. (The vent can stop short of the ends of the panel). The vent may be of conventional structure; for example, it may comprise a plurality of longitudinally extending levers. The lower side of vent 290 is on the exterior of panel 260. The lowest surfaces of board 264 and insulation member 270, which are preferably horizontal and coplanar, are above and spaced from vent 290 so as to provide an unobstructed air space above vent 290. Air entering vent 290 enters this air space, then flows successively through the air channels formed by projections 274 of insulation member 270 and the air channels in the main portion of the roofing system 240, which are formed by projections 54 of the insulation course 50. Finally, air may be vented from the main portion of the roofing system 240 through one or more roof vents not shown. If the air pressure is higher inside the roofing system 240 than outside, the direction of air flow is just the reverse, but in either case, efficient air circulation between the air space of the roofing system and the outside is obtained, so that water vapor does not build up and condense in the roofing system. At the same time, liquid water or moisture is prevented from entering the roofing system.

Three roofing systems and panels for installation at a perimeter of the roofing system, all in accordance with the present invention, have been shown and described in detail. All permit efficient air circulation and prevent or minimize condensation within a roofing system, and all essentially eliminate or prevent entry of liquid water or moisture from the outside.

While this invention has been described in detail with particular reference to specific embodiments including the best mode and preferred embodiment thereof, it will be apparent that various modifications can be made without departing from the scope and spirit of this invention.

What is claimed is:

1. A roofing system for a building structure, said roofing system comprising:

(a) a roof deck;

(b) a rigid roof support member above and spaced from said roof deck so as to provide an air space therebetween, said roof support member having opposite upper and lower surfaces, the upper surface being adapted to support a roof covering layer thereon;

(c) a roof covering layer disposed on the upper surface of said roof support member;

(d) at least one panel disposed along at least a portion of a perimeter of said roofing system, said panel being rectangular in shape and comprising:

(1) a rigid, coherent essentially rectangular board having spaced first and second surfaces and a longitudinally extending peripheral edge surface which intersects said first and second surfaces;

(2) a rectangular rigid foam insulation member adhered to the second surface of said board, said insulation member having portions cut away to provide a network of interconnected air channels in communication with the second surface of said board;

(3) protective sheet means including at least one sheet of air and water impermeable material for protecting said insulation member and said peripheral edge surface of said board; and (4) a vent associated with said protective sheet means, said vent extending lengthwise in proximity with and substantially parallel to said peripheral edge surface of said board, said vent being adapted to permit the passage of air and water vapor therethrough which excluding moisture.

2. A roofing system as claimed in claim 1, further comprising an insulation course interposed between said roof deck and said roof support member, said insulation course providing an air space adjacent to the lower surface of said roof support member.

3. A roofing system as claimed in claim 2 wherein said insulation course and said insulation member of said panel are each formed of a rigid foam material and each comprises a substantially imperforate first portion and a second portion comprising spaced projections extending from said first portion, said projections forming interconnected air channels therebetween, the channels formed in said insulation member of said panel being in communication with the air channels formed in said insulation course so that air entering said vent may diffuse throughout the entire roofing system.

4. A roofing system as claimed in claim 1, said roofing system comprising a sloping roof, said roof support member and said board of said panel being substantially aligned and disposed at an acute angle to the horizontal, said at least one panel being disposed along a lower edge of said sloping roof.

5. A roofing system as claimed in claim 4 wherein said protective sheet means comprises first and second protective sheets with said vent therebetween, said first protective sheet protecting said peripheral edge surface of said board and said second protective sheet extending downwardly from said vent.

6. A roofing system as claimed in claim 5 where an insulation member of said panel further includes a third portion which is thinner than said first portion and which extends laterally from said first portion toward a peripheral edge of said roof deck, and wherein a portion of said second sheet overlies an upper surface of said third portion of said insulation member and wherein opposite surfaces of said vent are adhered respectively to said first and second sheets.

7. A roofing system as claimed in claim 1, said roofing system comprising a flat roof wherein said roof deck and said rigid roof support member are essentially horizontal, said at least one panel being essentially upright and said rigid, coherent essentially rectangular board being essentially vertical.

8. A panel for installation at a perimeter of a roofing system, said panel being adapted to be installed along a peripheral edge of a roof and in proximity with a vertical exterior surface of a building structure, said panel being of rectangular shape and comprising:

(a) a rigid coherent essentially rectangular board having spaced first and second surfaces and a longitudinally extending peripheral edge surface which intersects said first and second surfaces;

(b) a rectangular rigid foam insulation member adhered to the second surface of said rigid rectangular board, said insulation member being rectangular in shape and having formed therein interconnected air channels which are in communication with said second surface of said board;

(c) protective sheet means including at least one sheet of air and water impermeable material for protecting said insulation member and said peripheral edge surface of said rigid board from moisture; and (d) a vent associated with said protective sheet means, said vent extending lengthwise in proximity with and substantially parallel to said peripheral edge surface of said board, said vent being adapted to permit the passage of air and water vapor therethrough while excluding moisture.

9. A panel as claimed in claim 8 wherein said insulation member is a rigid foam structure of a rectangular shape having an imperforate first portion which is spaced from said rigid board and a second portion comprising spaced projections extending from said first portion to the second surface of said board, said spaced projections defining therebetween a plurality of interconnected air channels.

10. A panel as claimed in claim 9 wherein said interconnected air channels comprise a first set of parallel passageways which are perpendicular to the peripheral edge of said board and a second set of passageways which are parallel to the peripheral edge of said board.

11. A panel as claimed in claim 8, said panel being adapted to be installed along an essentially horizontal lower edge of a sloping roof, said protective sheet means comprising first and second air and water impermeable sheets, said vent having opposed parallel first and second outer surfaces, the first outer surface of said vent being adhered to said first sheet, said second surface of said vent being adhered to said second sheet.

12. A panel as claimed in claim 11 wherein said first sheet is of generally U-shaped configuration which overlies a peripheral edge surface and adjacent portions of the first and second surfaces of said board.

13. A panel as claimed in claim 11 wherein said insulation member further includes a third portion which extends laterally from said first portion and is thinner than said first portion and terminates in a peripheral edge, said third portion being spaced from and parallel to said rigid board, said second sheet having a portion which overlies a surface of said third portion of said insulation member.

14. A panel as claimed in claim 8, wherein said protective sheet means comprises a sheet having first and second portions, said vent being between said first and second portions, said first portion being attached to said first surface of said rigid board, said second portion overlying peripheral edge portions of said rigid board and said insulation member and protecting the same from moisture.

* * * * *